US005659341A

United States Patent [19]

Kinas

[11] Patent Number: 5,659,341

[45] Date of Patent: Aug. 19, 1997

[54] ADJUSTABLE POSITION REFERENCE LEVER FOR A WIPER ASSEMBLY IN AN INK-JET PRINTER

[75] Inventor: Erick Kinas, Camas, Wash.

[73] Assignee: Hewlett-Packard Company, Palo Alto, Calif.

[21] Appl. No.: 233,861

[22] Filed: Apr. 26, 1994

[51] Int. Cl.[6] ..... B41J 2/165

[52] U.S. Cl. ..... 347/33

[58] Field of Search ..... 347/33, 32, 29

[56] References Cited

U.S. PATENT DOCUMENTS

| | | | |
|---|---|---|---|
| 4,437,105 | 3/1984 | Mrazek et al. | 347/29 |
| 4,511,906 | 4/1985 | Hara | 347/86 |
| 4,684,963 | 8/1987 | Naka | 347/29 |
| 4,709,246 | 11/1987 | Piatt et al. | 347/40 |
| 4,853,717 | 8/1989 | Harmon et al. | 347/29 |
| 5,000,594 | 3/1991 | Beehler et al. | 400/569 |
| 5,027,134 | 6/1991 | Harmon et al. | 347/29 |
| 5,455,609 | 10/1995 | Gost et al. | 347/32 |

FOREIGN PATENT DOCUMENTS

| | | |
|---|---|---|
| 0362897 | 4/1990 | European Pat. Off. . |
| 0443808 | 8/1991 | European Pat. Off. . |
| 0447262 | 9/1991 | European Pat. Off. . |

OTHER PUBLICATIONS

Harmon et al, "Integrating the Printhead in the HP DeskJet Printer", Hewlett Packard Journal, Oct. 1988, pp. 62–66.

Jackson et al, "DeskJet Printer Chasis and Mechanism Design", Hewlett Packard Journal Oct. 1988, pp. 67–75.

"Desk Writer C" product, a product on sale as described in Appendix A.

*Primary Examiner*—John E. Barlow, Jr.

[57] ABSTRACT

A wiper assembly for an ink-jet printer includes a sled subassembly movable between retracted and activated positions. A wiper is mounted on the sled subassembly to clean a nozzle section of the ink-jet print head when the sled subassembly is in an activated position. A movable rack supports and moves the sled subassembly between the retracted and activated positions. An adjustable position reference lever is operably mounted adjacent to the rack to establish a reference travel position for the sled subassembly between the retracted and activated positions. The position reference lever is capable upon adjustment of changing the reference travel position. In its preferred form, the position reference lever consists of a primary lever and a secondary lever movably connected to the primary lever. The secondary lever defines the reference travel position for the wiper assembly between the retracted and activated positions and is movable relative to the primary lever to change the reference travel position.

20 Claims, 4 Drawing Sheets

ADJUSTABLE POSITION REFERENCE LEVER FOR A WIPER ASSEMBLY IN AN INK-JET PRINTER

TECHNICAL FIELD

This invention relates to ink-jet printers, and more particularly, to wiper assemblies used in ink-jet printers.

BACKGROUND OF THE INVENTION

An ink-jet printer is a type of non-impact printer which forms characters and other images by controllably spraying drops of ink from a print head. The print head ejects ink through multiple nozzles in the form of annular drops which travel across a small air gap and land on a recording media. The drops are very small as ink-jet printers commonly print within a range of 180 to 600 dots per inch (dpi). The ink drops dry shortly thereafter to form in combination the desired printed images.

Ink droplets are ejected from individual nozzles by localized heating. A small heating element is disposed at individual nozzles. An electrical current is passed through the element to heat it up. This causes a tiny volume of ink to be rapidly heated and vaporized by the heating element and ejected through the nozzle. A driver circuit is coupled to individual heating elements to provide the energy pulses and thereby controllably deposit ink drops from associated individual nozzles. Such drivers are responsive to character generators and other image forming circuitry to energize selected nozzles of the print head and thereby form desired images on the recording media.

During printing, ink tends to build up at the nozzle orifices on the print head. This build-up can be caused by excess ink at the orifice that is not vaporized during ejection or ink splatterings that reflect from the recording media. The resident ink on the print head can clog the nozzle orifices and detrimentally disrupt or impair proper printing.

Accordingly, conventional ink-jet printers are equipped with movable wiper assemblies designed to periodically clean the nozzle section of the ink-jet print head to remove any resident ink. The wiper assembly has individual wipers which engage and scrub the orifices on the print head. The wiper assembly is alternately moved to an activated position suitable for cleaning the print head and then to a retracted position where it does not interfere with the print head during printing. As an example, wiper assemblies typically wipe the print head nozzle section once every ten seconds.

This invention concerns proper adjustment of the wiper assembly relative to the print head, and more particularly, to proper initialization of the wiper assembly position. Prior to each wiping operation, the wiper assembly is first moved to a reference position. This reference position is established by a position lever, such as the prior art lever shown in FIGS. 4 and 5, and discussed below in detail. After the wiper assembly reaches its home position, it is then subsequently moved a preset distance to the activated position which allows the wipers to engage the nozzle section.

In prior art ink-jet printers, the reference initialization position for the wiper assembly that is set by the position lever is fixed and cannot be adjusted during manufacturing. A problem arises in that the initializing reference position may end up being inaccurate due to manufacturing tolerances and mechanical imperfections that occur in the production and assembly of an ink-jet printer. If the inaccuracy is severe, the wiper assembly will always initialize to an incorrect reference position which, in some cases, can prevent the wiper assembly from fully or completely cleaning the print head as designed.

Accordingly, it is a goal of this invention to provide a mechanism for establishing the appropriate wiper assembly initializing reference position for a given printer which accounts for any manufacturing tolerances or mechanical imperfections.

DISCLOSURE OF THE INVENTION

This invention provides a wiper assembly for an ink-jet printer that has an adjustable initializing reference position lever. More particularly, the wiper assembly includes a sled subassembly movable between retracted and activated positions and at least one wiper mounted on the sled subassembly to clean a nozzle section of the ink-jet print head when the sled subassembly is in an activated position. A movable rack supports and moves the sled subassembly between the retracted and activated positions. An adjustable position reference lever is operably mounted adjacent to the rack to establish a reference travel position for the sled subassembly between the retracted and activated positions. The position reference lever is capable upon adjustment of changing the reference travel position.

In its preferred form, the position reference lever consists of a primary lever and a secondary lever movably connected to the primary lever. The secondary lever defines the reference travel position for the wiper assembly between the retracted and activated positions and is movable relative to the primary lever to change the reference travel position.

BRIEF DESCRIPTION OF THE DRAWINGS

Preferred embodiments of the invention are described below with reference to the following accompanying drawings depicting examples embodying the best mode for practicing the invention.

DETAILED DESCRIPTION OF THE PREFERRED EMBODIMENTS

This invention is intended for use in an ink-jet printer. An ink-jet printer has one or more ink-jet print heads which controllably deposit drops of ink in prescribed patterns onto a recording media, such as paper. A typical ink-jet print head has multiple nozzles (e.g., 50 nozzles). U.S. Pat. No. 4,910,528 describes one possible print head construction in more detail. This U.S. Pat. No. 4,910,528 is incorporated herein by reference.

Figure 1:
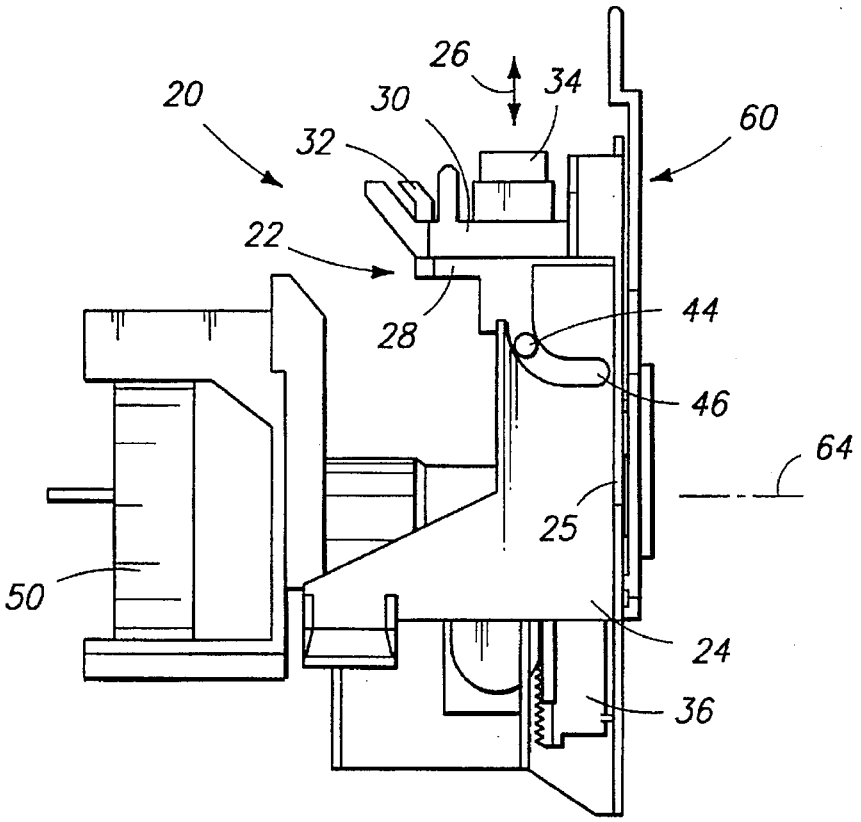
FIG. 1 is a side view of a wiper assembly equipped with an adjustable position reference lever according to this invention.

FIG. 1 shows a wiper assembly 20 for an ink-jet printer. The wiper assembly is designed to clean the nozzle section of the ink-jet print head (not shown). Wiper assembly 20 includes a sled subassembly 22 that is movable relative to frame 24 for vertical positioning (as indicated by arrow 26) between an elevationally lower retracted position and an elevationally higher activated position.

Sled subassembly 22 has a sled 30 detachably connected to a sled clamp 28 via deflectable clips 32. Sled 30 carries at least one wiper 34 on its upper surface. Wiper 34 is formed of a resilient material, such as rubber or an elastomer. When sled subassembly 22 is elevated to an activated position, wiper 34 engages and cleans the nozzle section of an ink-jet print head to remove excess ink from the nozzle orifices. This scrubbing action prevents ink build-up and clogging of the print head nozzle orifices.

Figure 2:
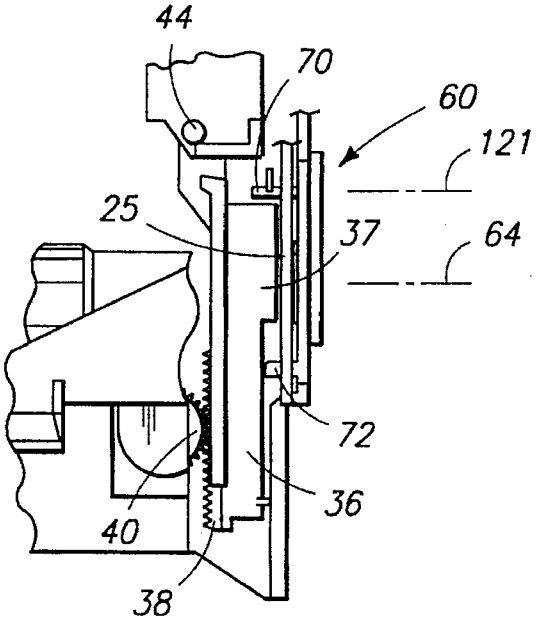
FIG. 2 is a partial side view of the FIG. 1 wiper assembly having a portion of the frame cut away to demonstrate the operation of the adjustable position reference lever.

As illustrated in FIGS. 1 and 2, wiper assembly 20 includes a moveable rack 36 which supports and moves sled subassembly 22 between the retracted and activated positions. Rack 36 is movably mounted to frame 24 to be vertically raised and lowered relative to the frame. Rack 36 includes a linear gear coupling 38 which mates with a circular drive gear 40 to index the rack up and down relative to frame wall 25. Sled subassembly 22 (or more particularly, sled clamp 28) is pivotally attached to rack 36. Sled clamp 28 includes a guide peg 44 which travels through an arcuate guide path 46 to pivot sled subassembly 22 approximately 90° from a horizontal position (shown in FIG. 1) to a vertical position.

Wiper assembly may also include a motor 50 mounted to frame 24 and operably coupled to drive gear 40. Motor 50 is preferably a stepper motor which changes speed and direction in response to electric pulses. A stepper motor provides movement in small step increments. An example step increment translates to a linear movement of sled subassembly 22 of approximately 0.147 mils ($1.47\times10^{-5}$ inch).

To raise sled subassembly 22 to its activated cleaning position, motor 50 rotates drive gear 40 in a counterclockwise direction causing rack 36 to move upward. Peg 44 on sled clamp 28 follows the guide path to swing sled 30 to its horizontal position where wiper 34 can contact the print head nozzle section. Conversely, to lower sled subassembly 22 to a retracted position, motor 50 rotates drive gear 40 in a clockwise direction indexing rack 36 downward. Peg 44 on sled clamp 28 follows arcuate guide path 46 to pivot sled 30 and wiper 34 to a vertical position away from the print head. In this retracted position, sled subassembly 22 does not interfere with the normal operation of the print head.

Figure 3:
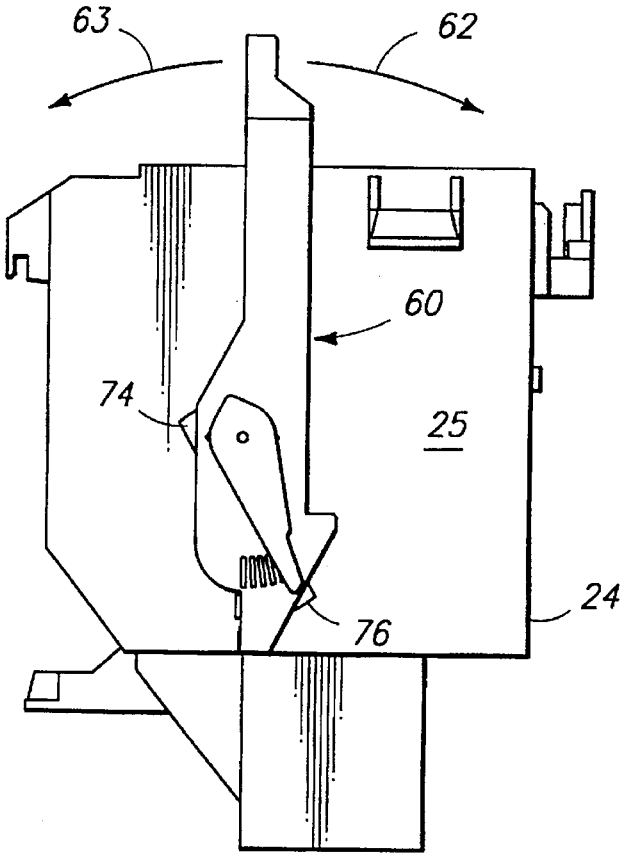
FIG. 3 is a front view of the FIG. 1 wiper assembly and illustrates the adjustable position reference lever of this invention.

As shown in FIGS. 1–3, wiper assembly 20 also includes an adjustable position reference lever assembly 60 mounted on the front side of frame 24 adjacent to rack 36, but separated by frame wall 25. Position reference lever assembly 60 is rotatably mounted to frame 24 to rotate back and forth (as indicated by arrows 62 and 63 in FIG. 3) about a lever assembly pivot axis 64 (FIGS. 1 and 2). Position reference lever assembly 60 establishes at least one, and preferably two, reference travel positions for wiper assembly 20 between the retracted and activated positions which are used to calibrate travel operations of the wiper assembly.

Position reference lever assembly 60 has a movable upper reference member 70 for establishing a top reference travel position for rack 36 and sled subassembly 22. Upper reference member 70 is adjustable to provide multiple top reference travel positions, as is described below in more detail. Lever assembly 60 also has a fixed lower reference member 72 spaced a selected distance from upper reference member 70 for establishing a bottom reference travel position for rack 36 and sled subassembly 22.

Support rack 36 includes a position initializing flange stop 37 (FIG. 2) of a predetermined length which projects toward frame wall 25 and lever assembly 60. Flange stop 37 moves with rack 36 to operably abut upper and lower reference members 70, 72 to thereby establish reference positions of the rack and sled subassembly. As rack 36 is vertically elevated toward an activated position, stop 37 engages upper reference member 70 causing the rack to cease its upward travel. Stepper motor 50 is unable to drive rack 36 any farther upward. As a result, the wiper assembly is calibrated to a top reference travel position which can be used as the starting point for incremental travel of sled subassembly 22 a preselected distance to the activated position for the cleaning operation.

Similarly, as rack 36 is lowered toward a retracted position, stop 37 engages lower reference member 72 to halt downward travel of the rack. In this manner, the wiper assembly is calibrated to a bottom reference travel position which can be used as an initializing position reference for other wiper operations.

Once the top or bottom reference travel position is established, lever assembly 60 is rotated from its engaged position (shown in FIG. 3) about lever assembly pivot axis 64 to a disengaged position as indicated by arrow 63. Slots 74 and 76 are formed in frame wall 25 to permit movement of upper reference member 70 and lower reference member 72, respectively. When lever assembly 60 is located in the disengaged position, upper and lower reference members 70, 72 are removed from the vertical path of flange stop 37 to thereby allow full travel of rack 36 and sled subassembly 22.

One important task of position reference lever assembly 60 is to establish a zero position for sled subassembly 22 prior to conducting the cleaning operation on a nose section of an ink-jet print head. Lever assembly 60 is first moved to its engaged position as indicated by arrow 62. Rack 36 is then vertically elevated until stop 37 abuts upper reference member 70. At this point, lever assembly 60 is rotated to its disengaged position as indicated by arrow 63 to withdraw upper reference member 70 from the path of rack stop 37. Rack 36 is then indexed upward a preselected number of steps by stepper motor 50 to ensure good wiper contact with the nozzle section of the print head.

Position reference lever assembly 60 of this invention is advantageous because it is capable of changing the top reference travel position established by upper reference member 70. Said another way, lever assembly 60 is capable of changing the selected distance between upper and lower reference members 70 and 72 to thereby alter the reference travel positions.

Figure 4:
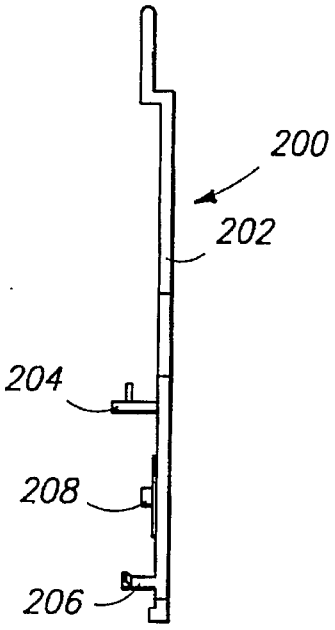
Fig 4 PRIOR ART
FIG. 4 is a side view of a prior art position reference lever.
Figure 5:
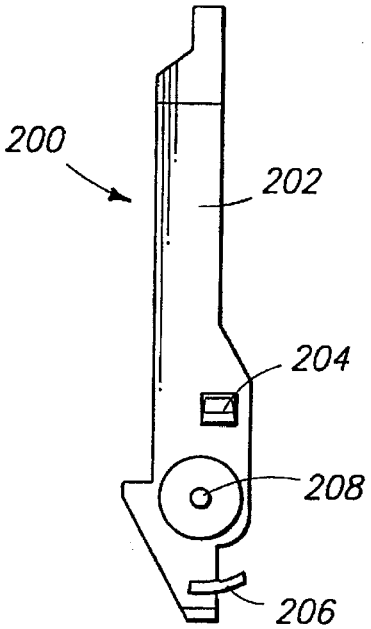
Fig 5 PRIOR ART
FIG. 5 is a back side view of the prior art position reference lever of FIG. 4.

The advantages of this invention are best understood with an initial explanation of the prior art position reference lever illustrated in FIGS. 4 and 5. Prior art reference lever 200 includes a body 202, a fixed upper reference member 204, a fixed lower reference member 206, and a central pivot peg 208. When connected to wiper assembly 20, lever 200 is rotated about peg 208 between its engaged and disengaged positions. Upper reference member 204 establishes the top reference travel position of the wiper assembly and lower reference member 206 establishes the bottom reference travel position of the sled assembly.

Reference members 204 and 206 are fixed and cannot be adjusted to change the reference travel positions. Accordingly, if the tolerances or mechanical alignment considerations in constructing the ink-jet printer are inaccurate, it is possible that the wiper assembly will be permanently referenced to an improper top reference travel position, thus never properly initializing the wiper assembly for full extension to the appropriate activated wiping position. The adjustable position reference lever of this invention overcomes this drawback.

FIGS. 6–11 illustrate the adjustable position reference lever assembly 60 of this invention in more detail. Lever assembly 60 includes a primary lever 80 and a detachable secondary lever 100 that is rotatably connected to primary lever 80. Lower reference member 72 is provided on the bottom section of primary lever 80 to define a bottom reference travel position for wiper sled subassembly 22. Upper reference member 70 is provided on secondary lever 100 to establish the top reference travel position for the wiper assembly. Secondary lever 100 can be rotated relative to primary lever 80 about secondary lever pivot axis 121 to controllably change the top reference travel position, as well as the distance between the upper and lower reference members 70, 72.

Primary lever 80 has a front side 82, a back side 84, an upper section 86, a middle section 88, and a lower section 90. Lower reference member 70 is fixed to back side 84 in lower section 90. Lever assembly 60 also includes a coupling aperture 92 (FIGS. 6 and 10) of selected shape formed in middle section 88. In the preferred embodiment, coupling aperture 92 is approximately "eye"-shaped. Primary lever 80 has a pivot peg 96 centered in a raised bearing disk 98 provided in middle section 88. Pivot peg 96 defines lever assembly pivot axis 64 (FIGS. 1, 2, and 8) when operably mounted to frame 24.

Secondary lever 100 includes a coupling flange 102 which is complementary in shape to, and received within, coupling aperture 192 of primary lever 80. Preferably, coupling flange 102 is "eye"-shaped and sized to fit through aperture 92 when secondary lever 100 is oriented approximately perpendicular to primary lever 80. Once flange 102 is inserted into aperture 92, secondary lever 100 can be reoriented along primary lever 80 as shown. Outer extensions 104 of flange 102 are rotated within a circular recessed area 106 (FIG. 10) to hold the secondary lever 100 against primary lever 80. In this manner, coupling aperture 92 and coupling flange 102 define an assembly coupling 101 which detachably connects secondary lever 80 to primary lever 80.

Secondary lever 100 has a calibration arm 110 positioned on front side 82 of primary lever 80. Upper reference member 70 projects from calibration arm 110 through coupling aperture 92 in primary lever 80 and extends beyond back side 84 of the primary lever. An arcuate flange 114 is provided on reference member 70 to help releasibly secure and hold position lever assembly 60 to frame wall 25.

Figure 10:
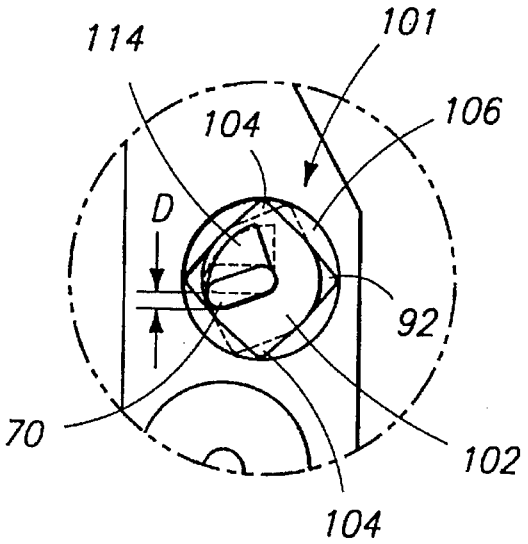
FIG. 10 is an enlarged view taken within circle 10 of FIG. 7 and illustrates a rotatable upper reference member used to change the reference travel position of the FIG. 1 wiper assembly.
Figure 11:
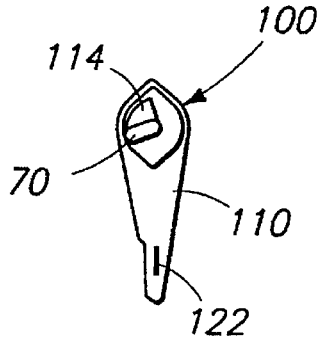
FIG. 11 is a back side view of the secondary lever of the position reference lever assembly.

According to this invention, movement of calibration arm 110 causes rotation of upper reference member 70 to thereby change the top reference travel position by a selected distance D (FIG. 10). This rotational movement also effectively changes the selected distance between rotatable upper reference member 70 and fixed lower reference member 72. Preferably, upper reference member 70 is rotatable an amount effective to change the top reference travel position by a maximum of approximately 35 mils (0.035 inch) or less, with 28 mils (0.028 inch) being most preferred.

Figure 6:
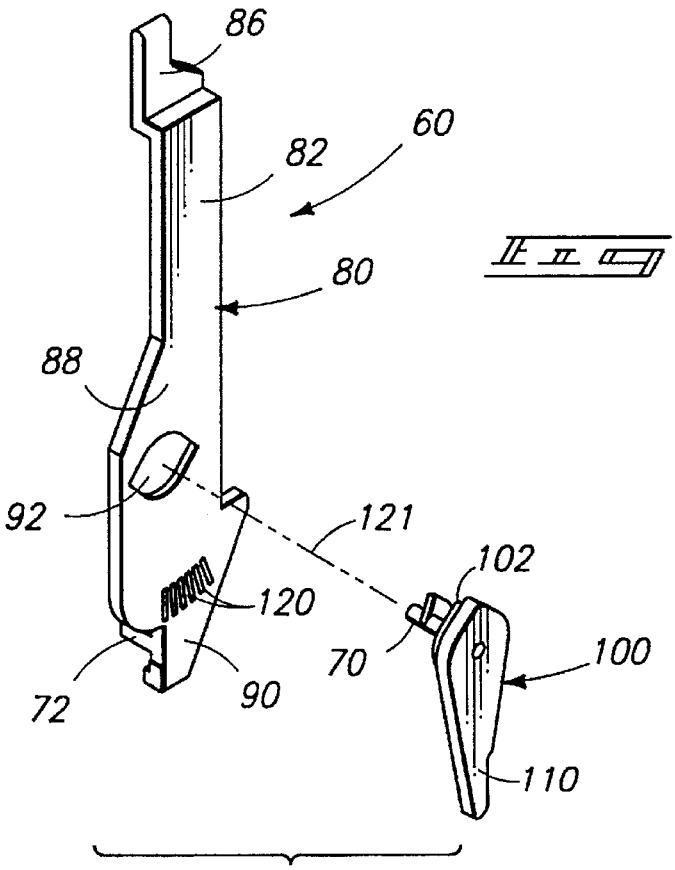
FIG. 6 is an exploded isometric view of the adjustable position reference lever assembly according to this invention which includes a primary lever and a secondary lever.
Figure 7:
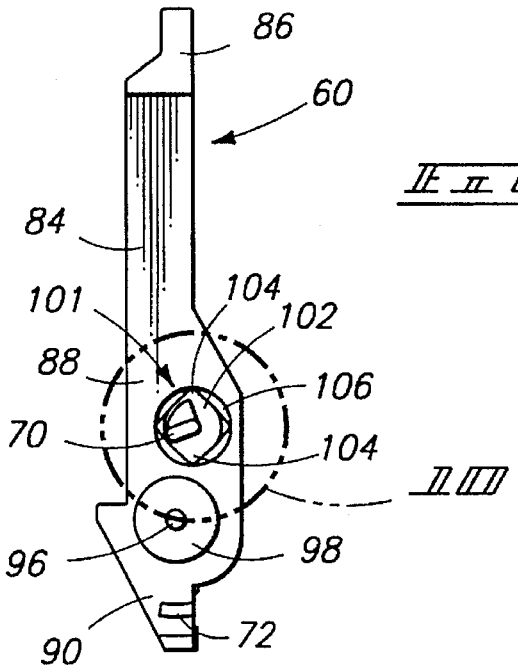
FIG. 7 is a back side view of the adjustable position reference lever assembly.
Figure 8:
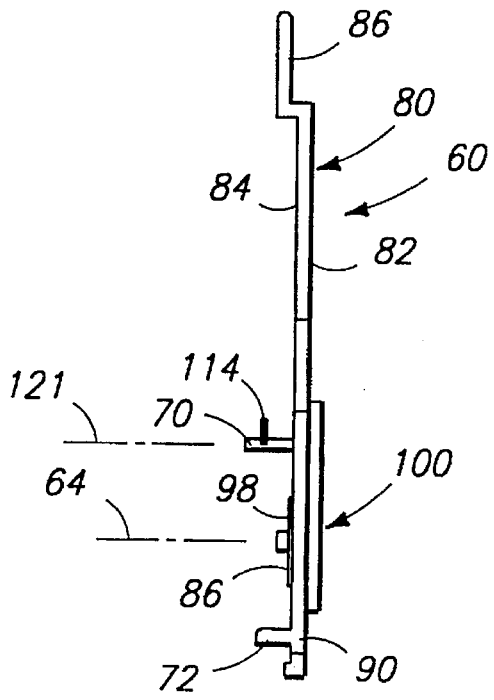
FIG. 8 is a side view of the adjustable position lever assembly.
Figure 9:
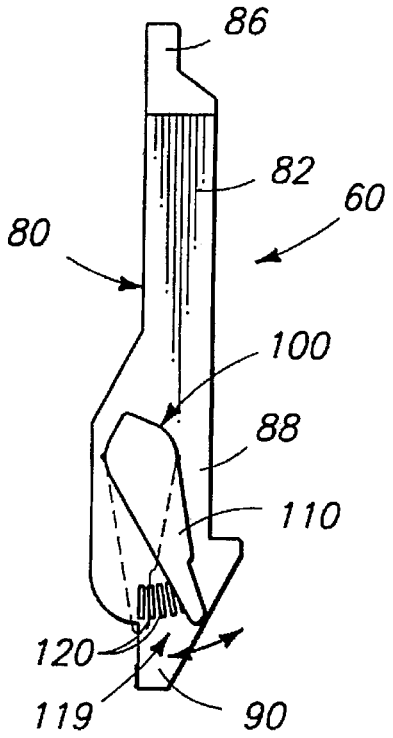
FIG. 9 is a front side view of the adjustable position reference lever assembly.

Adjustable position reference lever assembly 60 also includes multiple spaced calibration indentations 120 formed in front side 82 of primary lever 80 (FIGS. 6 and 9). Indentations 120 are radially oriented about secondary lever pivot axis 121.

A detent 122 (FIG. 11) is provided on calibration arm 110 of secondary lever 100 and is sized to fit within indentations 120. Detent 122 can be selectively inserted into indentations 120 to define selected settings of the calibration arm. Movement of the calibration arm from one setting to an adjacent setting provides a discrete increment of adjustment for upper reference member 70. Preferably, six indentations are formed in front side 82. For a maximum displacement of approximately 28 mils, each discreet increment of adjustment between adjacent indentations is approximately 5 mils. In this manner, indentations 120 and detent 122 form a calibration means 119 for providing predefined settings of the calibration arm 110, and hence, the upper reference member 70.

The adjustable position reference lever assembly of this invention is capable upon adjustment of changing the upper reference member and thus the selected distance between the upper and lower reference members. This allows for adjustment in the top reference travel position of sled subassembly 22. Although the preferred embodiment adjusts the upper reference member, the principles of this invention could also be applied to construct a secondary lever designed to adjust the lower reference member of the lever assembly.

The adjustable position reference lever assembly of this invention is therefore advantageous over prior art levers in that it provides a variable reference travel position for the wiper assembly. Secondary lever 100 can be set to the desired indentation during manufacturing to establish the desired top reference travel position for that given ink-jet printer. It is believed that this would be a one-time adjustment made during manufacturing, although the lever assembly can be further adjusted during the life of the printer if desired. The adjustable lever can thereby accommodate tolerances and mechanical imperfections which may otherwise cause a slight error in the positional movement of the wiper assembly. Accordingly, this invention provides an inexpensive solution to the problem of wiper assembly misregistration.

In compliance with the statute, the invention has been described in language more or less specific as to structural features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A wiper assembly for an ink-jet printer, the ink-jet printer having an ink-jet print head, the wiper assembly comprising:

a frame;

a sled subassembly movable between retracted and activated positions;

at least one wiper mounted on the sled subassembly to clean a nozzle section of the ink-jet print head when the sled subassembly is in an activated position;

a rack moveably mounted to the frame for supporting and moving the sled subassembly between the retracted and activated positions; and an adjustable position reference lever movably mounted to the frame to move between engaged and disengaged positions so that when moved to the engaged position, the adjustable position reference lever establishes a reference travel position for the sled subassembly between the retracted and activated positions, the adjustable position reference lever being adjustable to change the reference travel position.

2. A wiper assembly according to claim 1 wherein the adjustable position reference lever has multiple settings where movement from one setting to another setting provides discrete increments of adjustment of the reference travel position.

3. A wiper assembly according to claim 1 wherein the adjustable position reference lever has a movable reference member defining the reference travel position for the sled subassembly, the reference member being moved to controllably change the reference travel position.

4. A wiper assembly according to claim 1 wherein the adjustable position reference lever includes:

an upper reference member for establishing a top reference travel position for the sled subassembly;

a lower reference member spaced a selected distance from the upper reference member for establishing a bottom reference travel position for the sled subassembly; and the position reference lever being capable upon adjustment of changing the selected distance between the upper and lower reference members.

5. A wiper assembly according to claim 1 wherein the adjustable position reference lever includes:

an upper reference member for establishing a top reference travel position for the sled subassembly;

a lower reference member spaced a selected distance from the upper reference member for establishing a bottom reference travel position for the sled subassembly; and the position reference lever being capable upon adjustment of changing the selected distance between the upper and lower reference members by a maximum of approximately 35 mils or less.

6. A wiper assembly according to claim 1 wherein the adjustable position reference lever includes:

a movable upper reference member for establishing a top reference travel position for the sled subassembly;

a fixed lower reference member spaced a selected distance from the upper reference member for establishing a bottom reference travel position for the sled subassembly; and the upper reference member being movable relative to the fixed lower reference member to controllably change the selected distance between the upper and lower reference members.

7. A wiper assembly according to claim 1 wherein the adjustable position reference lever includes:

a rotatable upper reference member for establishing a top reference travel position for the sled subassembly;

a fixed lower reference member spaced a selected distance from the upper reference member for establishing a bottom reference travel position for the sled subassembly; and rotation of the upper reference member being effective to controllably change the top reference travel position by a maximum of approximately 35 mils or less.

8. In an ink-jet printer having a wiper assembly which is moveable between retracted and activated positions to clean a nozzle section of an ink-jet print head when the wiper assembly is in an activated position, an adjustable position reference lever assembly for use in the wiper assembly comprising:

a primary lever; and a secondary lever movably connected to the primary lever, the secondary lever defining a reference travel position for the wiper assembly between the retracted and activated positions, the secondary lever being moveable relative to the primary lever to change the reference travel position.

9. An adjustable position reference lever assembly according to claim 8 further comprising a coupling for detachably connecting the secondary lever to the primary lever.

10. An adjustable position reference lever assembly according to claim 8 further comprising a coupling for detachably connecting the secondary lever to the primary lever, the coupling comprising a coupling aperture formed in the primary lever and a coupling flange provided on the secondary lever that is complementary to and received within the coupling aperture.

11. An adjustable position reference lever assembly according to claim 8 wherein the secondary lever is rotatably connected to the primary lever, the secondary lever having a reference member defining the reference travel position for the wiper assembly, the secondary lever being rotated relative to the primary lever to controllably change the reference travel position.

12. An adjustable position reference lever assembly according to claim 8 wherein the secondary lever is rotatably connected to the primary lever, the secondary lever having a reference member defining the reference travel position for the wiper assembly, the secondary lever being rotated relative to the primary lever to controllably change the reference travel position by a maximum of approximately 35 mils or less.

13. An adjustable position reference lever assembly according to claim 8 wherein:

the primary lever has a fixed reference member defining a first reference travel position for the wiper assembly; and the secondary lever has a movable reference member spaced a selected distance from the fixed reference member, the movable reference member defining a second reference travel position for the wiper assembly.

14. An adjustable position reference lever assembly according to claim 8 wherein:

the primary lever has a fixed lower reference member defining a bottom reference travel position for the wiper assembly; and the secondary lever is rotatably connected to the primary lever, the secondary lever having an upper reference member spaced a selected distance from the lower reference member, the upper reference member defining a top reference travel position for the wiper assembly, the secondary lever being rotated relative to the primary lever causing the upper reference member to rotate and thereby controllably change the top reference travel position.

15. An adjustable position reference lever assembly according to claim 8 further comprising:

multiple spaced calibration indentations formed in the primary lever; and the secondary lever having a detent sized to fit within the indentations to define selected position settings of the secondary lever relative to the primary lever, movement of the secondary lever from one setting to an adjacent setting providing discrete increments of adjustment of the reference travel position.

16. An adjustable position reference lever assembly for a wiper assembly in an ink-jet printer, the wiper assembly being moveable between retracted and activated positions to clean a nozzle section of an ink-jet print head when the wiper assembly is in an activated position, the position reference lever assembly comprising:

a primary lever having a front side, a back side, an upper section, a middle section, and a lower section;

the primary lever having a coupling aperture formed in the middle section;

a detachable secondary lever rotatably connected to the primary lever, the secondary lever having a coupling flange complementary to and received within the coupling aperture to detachably connect the secondary lever to the primary lever; and the secondary lever having a calibration arm positioned on the front side of the primary lever and a reference member projecting from the calibration arm through the coupling aperture to the back side of the primary lever, the reference member defining a reference travel position for the wiper assembly between the retracted and activated positions, movemeht of the calibration arm causing rotation of the reference member to thereby change the reference travel position.

17. An adjustable position reference lever assembly according to claim 16 wherein the reference member is rotatable an amount effective to change the reference travel position a maximum of approximately 35 mils or less.

18. An adjustable position reference lever assembly according to claim 16 wherein the reference member is rotatable an amount effective to change the reference travel position a maximum of approximately 28 mils.

19. An adjustable position reference lever assembly according to claim 16 further comprising:

multiple spaced calibration indentations formed in the front side of the primary lever; and the calibration arm of the secondary lever having a detent sized to fit within the indentations to define selected settings of the calibration arm, movement of the calibration arm from one setting to an adjacent setting providing discrete increments of adjustment of the reference member.

20. An adjustable position reference lever assembly according to claim 16 wherein:

the reference member of the secondary lever defines a top reference travel position for the wiper assembly; and the primary lever has a fixed reference member provided at the back side, lower section thereof; the fixed reference member defining a bottom reference travel position for the wiper assembly.

* * * * *